US010514036B2

(12) United States Patent
Brown et al.

(10) Patent No.: US 10,514,036 B2
(45) Date of Patent: Dec. 24, 2019

(54) ROTOR FOR A POSITIVE DISPLACEMENT COMPRESSOR

(71) Applicant: GM GLOBAL TECHNOLOGY OPERATIONS LLC, Detroit, MI (US)

(72) Inventors: Tyson W. Brown, Royal Oak, MI (US); Anil K. Sachdev, Rochester Hills, MI (US); Carnell E. Williams, Southfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 273 days.

(21) Appl. No.: 15/659,088

(22) Filed: Jul. 25, 2017

(65) Prior Publication Data

US 2019/0032660 A1 Jan. 31, 2019

(51) Int. Cl.

| | |
|---|---|
| ***F04C 18/08*** | (2006.01) |
| ***F04C 29/12*** | (2006.01) |
| ***F04C 29/00*** | (2006.01) |
| ***F02B 33/38*** | (2006.01) |
| ***F04C 18/56*** | (2006.01) |
| ***F04C 18/16*** | (2006.01) |
| ***F04C 18/12*** | (2006.01) |

(52) U.S. Cl.

CPC ..... *F04C 18/084* (2013.01); *F02B 33/38* (2013.01); *F04C 18/16* (2013.01); *F04C 18/56* (2013.01); *F04C 29/0085* (2013.01); *F04C 29/122* (2013.01); *F04C 18/126* (2013.01); *F04C 2240/20* (2013.01); *F04C 2240/40* (2013.01); *F04C 2250/20* (2013.01)

(58) Field of Classification Search

CPC ..... F02B 33/38; F04C 18/084; F04C 18/126; F04C 2240/20; F04C 2240/40; F04C 2250/20; F04C 29/0085; F04C 29/122; F01C 1/123; F01C 1/126

USPC ..... 418/197, 201.1; 123/202

See application file for complete search history.

(56) References Cited

U.S. PATENT DOCUMENTS

| | | | | |
|---|---|---|---|---|
| 3,116,871 | A | 1/1964 | Yoshihiro et al. | |
| 2005/0109309 | A1* | 5/2005 | Lockett | F01C 1/123 123/202 |
| 2016/0003045 | A1* | 1/2016 | Fortini | F01C 1/126 418/197 |
| 2017/0067464 | A1 | 3/2017 | Swartzlander | |

FOREIGN PATENT DOCUMENTS

| | | | |
|---|---|---|---|
| JP | 2002130164 | A | 5/2002 |

* cited by examiner

*Primary Examiner* — Essama Omgba
*Assistant Examiner* — Paul W Thiede
(74) *Attorney, Agent, or Firm* — Reising Ethington P.C.

(57) ABSTRACT

A rotor for a positive displacement compressor assembly having a housing defining an inlet, an outlet, and a rotor cavity in communication with the inlet and the outlet. The rotor may comprise a rotor body and a porous inner core enclosed within the rotor body. The rotor may comprise a tapered rotor body having an outer radius that decreases from a first end to a second end thereof. In one form, the positive displacement compressor assembly may comprise a supercharger assembly for an internal combustion engine.

16 Claims, 3 Drawing Sheets

ROTOR FOR A POSITIVE DISPLACEMENT COMPRESSOR

TECHNICAL FIELD

The present disclosure is directed to rotors for compressors, and more particularly to rotors for rotating positive displacement compressors.

INTRODUCTION

Rotating positive displacement compressors, including screw compressors, sliding vane compressors, and lobe compressors (or roots blowers), include one or more rotating elements and operate by drawing in and capturing a volume of fluid (e.g., air) in a chamber, then reducing the volume of the chamber to compress the fluid and increase its pressure prior to discharge. Screw compressors include two intermeshing helical screws, known as rotors, having different circumferential profiles, one male and one female. The male rotor has convex lobes that mesh with concave cavities in the female rotor during rotation of the rotors. Lobe compressors include two identical intermeshing rotors that typically include two, three, or four straight or twisted (helical) lobes. In operation, the rotors of a screw or lobe compressor rotate in opposite directions to guide a volume of fluid from an inlet side of the compressor into a cavity surrounding the rotors such that the fluid is confined between the lobes of the rotors and the cavity walls. The fluid moves from the inlet side of the compressor, around the rotors, and is forced out of the compressor at an opposite outlet side of the compressor. Sliding vane compressors each include a single cylindrical rotor having longitudinal slots in which radial sliding vanes are fitted. The rotor of a sliding vane compressor is positioned eccentrically within a cylindrical housing and the spaces between adjacent vanes form pockets of decreasing volume from a fixed inlet port to a fixed discharge port.

Positive displacement compressors are used in a variety of industrial and automotive applications. For example, a rotating positive displacement compressor referred to as a supercharger is oftentimes coupled to an air intake manifold of an internal combustion engine. The supercharger supplies pressurized air to the intake manifold and to the cylinders of the engine, which increases the power output of the engine. The rotors in a supercharger are typically driven by the engine through a drive belt or a train of gears connected to the crankshaft.

SUMMARY

A rotor for a positive displacement compressor assembly has a housing that defines an inlet, an outlet, and a rotor cavity in communication with the inlet and the outlet. The rotor may comprise a rotor body having a central longitudinal axis and an outer radius. The rotor body may comprise a first end adjacent the inlet of the housing, a second end adjacent the outlet of the housing, an axially extending hub, and a plurality of lobes extending radially outward from the hub and axially along the hub from the first end to the second end of the rotor body. The rotor body may comprise a solid outer casing and a porous inner core enclosed within the solid outer casting. The porous inner core may extend between the first end and the second end of the rotor body.

In one form, the porous inner core may comprise a plurality of discrete porous chambers, with each of the plurality of lobes enclosing one of the discrete porous chambers. In another form, the porous inner core may comprise a unitary structure enclosed within the rotor body.

The porous inner core may comprise a multidimensional stochastic or periodic support structure. In one form, the porous inner core may comprise a two or three-dimensional lattice support structure or truss including a plurality of repeating unit cells.

The outer radius of the rotor body at the first end thereof may be greater than the outer radius of the rotor body at the second end thereof.

Each of the plurality of lobes may extend in a straight or helical path along the rotor body.

The solid outer casing of the rotor body may have a textured or patterned outer surface.

A positive displacement compressor assembly may comprise a housing defining an inlet and an outlet, a pair of first and second shafts, and a pair of intermeshing first and second rotors. The housing may include a pair of end walls and a pair of intersecting sidewalls having inner wall surfaces that define first and second interconnected rotor cavities. The first and second shafts may extend within the rotor cavities and may be supported for rotation at the end walls of the housing. The first and second rotors may be respectively supported within the first and second rotor cavities by the first and second shafts. The first and second rotors may respectively comprise first and second rotor bodies having respective first and second central longitudinal axes and outer radii. The first and second rotor bodies may have respective first ends adjacent the inlet of the housing and respective second ends adjacent the outlet of the housing. Each of the first and second rotor bodies may have a first end face, an opposite second end face, an axially extending hub, and a plurality of lobes. The hub may be coupled to one of the shafts for rotation therewith. The plurality of lobes may extend radially outward from the hub and axially along the hub from the first end face to the second end face of the rotor body. A porous inner core may be enclosed within each of the first and second rotor bodies.

In one form, the first and second rotor cavities may be cylindrical in shape. In another form, the first and second rotor cavities may be frustoconical in shape.

The outer radii of the first and second rotor bodies at the first ends thereof may be greater than the outer radii of the first and second rotor bodies at the second ends thereof.

The first and second central longitudinal axes of the first and second rotor bodies may approach each other as the rotor bodies extend from the inlet to the outlet of the housing. The first and second central longitudinal axes of the first and second rotor bodies may form an acute angle therebetween.

The first and second shafts may extend outside the housing to form at least one drive shaft. The at least one drive shaft may be driven by an electric motor.

In one form, the plurality of lobes of the first and second rotor bodies may have different complementary helical shapes. In another form, the plurality of lobes of the first rotor body may be the same shape as the plurality of lobes of the second rotor body.

The positive displacement compressor assembly may comprise a supercharger assembly for an internal combustion engine.

DETAILED DESCRIPTION

The presently disclosed rotors may have a porous inner core, and thus may be relatively lightweight, as compared to rotors that are extruded or otherwise formed of solid material, without sacrificing the mechanical integrity of the rotors. Additionally or alternatively, the presently disclosed rotors may have tapered lobes and may be supported within a correspondingly tapered rotor cavity, which also may reduce the weight of the rotors and the noise generated during operation by minimizing or eliminating pulsing and fluid backflow. The rotors may have two, three, four, or more lobes and may be configured for use in a screw compressor, lobe compressor, or a sliding vane compressor, as desired. The presently disclosed rotors will be described herein with respect to a supercharger assembly for an internal combustion engine, although the scope of the present disclosure is not limited thereto. For example, the presently disclosed rotors may be employed in a variety of alternative applications and industries, such as in automatic control systems, for powering pneumatic tools, transporting fluids and powders, spot cooling, pressurizing tanks, agitating or aerating materials, packaging products, surface debris removal, and blow molding processes.

Figure 1:
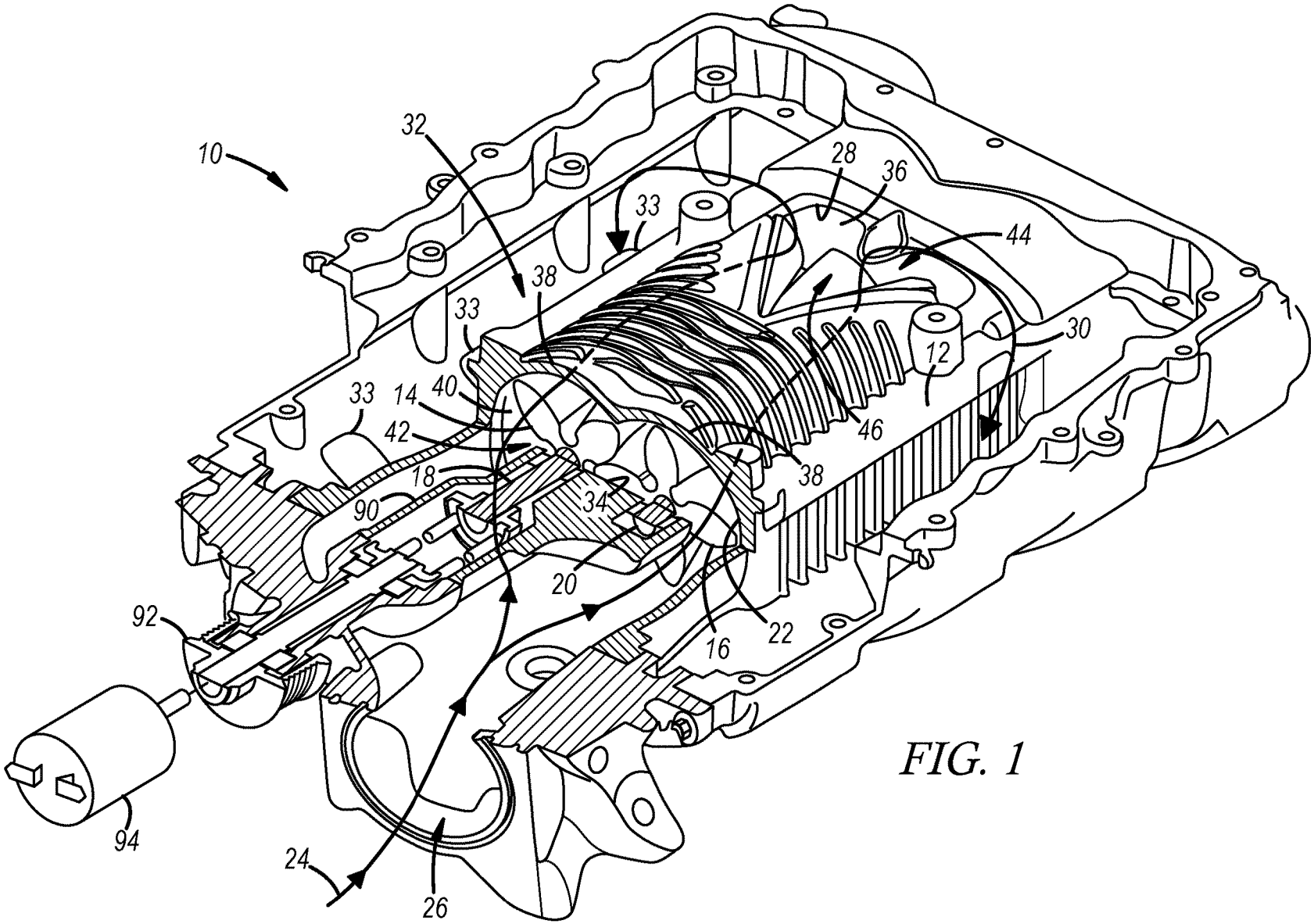
FIG. 1 is a perspective view of a supercharger assembly for an internal combustion engine, the supercharger assembly includes a pair of intermeshing helical lobed rotors mounted within a rotor cavity defined by a housing and extending between an inlet and an outlet of the supercharger assembly.

FIG. 1 illustrates a positive displacement compressor or supercharger assembly 10 for an internal combustion engine (not shown). The assembly 10 includes a housing 12 and a pair of intermeshing first and second rotors 14, 16 supported for rotation within the housing 12 by a pair of first and second shafts 18, 20.

The housing 12 defines an inlet 22 through which ambient air 24 is received via an air intake passage 26 and an outlet 28 through which compressed or pressurized air 30 is expelled from the housing 12 into an outlet plenum 32. In practice, the outlet plenum 32 may function as an air intake manifold, and pressurized air produced by the supercharger assembly 10 may be directed from the outlet plenum 32 into the cylinders (not shown) of the engine via a plurality of air intake openings 33 prior to the power stroke to increase the power output of the engine. In one form, a charge air cooler or intercooler (not shown) may be located within the outlet plenum 32 between the outlet 28 of the housing 12 and the air intake openings 33 to cool and thereby increase the density of the pressurized air before the air is charged into the cylinders.

The housing 12 includes an inlet end wall 34, an outlet end wall 36, and a pair of intersecting cylindrical sidewalls 38. The sidewalls 38 have inner wall surfaces 40 that respectively define first and second interconnected cylindrical rotor cavities 42, 44 that together form a larger unitary rotor cavity 46. The sidewalls 38 of the housing 12 are configured such that a minimal and constant amount of clearance exists between the inner wall surfaces 40 of the sidewalls 38 and the rotors 14, 16 to provide an effective seal between the inlet 22 and the outlet 28 of the housing 12 and to prevent scuffing of the wall surfaces 40 and the rotors 14, 16 during rotation of the rotors 14, 16. In one form, the inlet 22 of the housing 12 may comprise an opening in the inlet end wall 34 of the housing, and the outlet 28 of the housing may comprise a triangular opening in the pair of intersecting cylindrical sidewalls 38 that extends from the outlet end wall 36 toward the inlet end wall 34.

The first and second shafts 18, 20 extend within the respective first and second rotor cavities 42, 44 and are supported for rotation at the end walls 34, 36 of the housing 12. The first shaft 18 is coaxial with the first rotor 14 and with the first rotor cavity 42, and the second shaft 20 is coaxial with the second rotor 16 and the second rotor cavity 44. In one form, one or both of the first or second shafts 18, 20 may extend outside the housing 12 to form at least one drive shaft. In the embodiment depicted in FIG. 1, the first shaft 18 extends outside the housing 12 to a coupling mechanism 90 and to a belt drive 92, which may be powered by a crankshaft (not shown) of the engine. In such case, the first shaft 18 (and its associated rotor 14) may be driven by the belt drive 92 and the second shaft 20 (and its associated rotor 16) may be driven by a set of gears (not shown) connected to the first shaft 18. Alternatively, one or both of the shafts 18, 20 may be driven by a designated electric motor 94 to allow the supercharger assembly 10 to operate independently of the speed of the internal combustion engine with which it is associated. For example, the first shaft 18 (and its associated rotor 14) may be driven by the electric motor 94 and the second shaft 20 (and its associated rotor 16) may be driven by a set of gears (not shown) connected to the first shaft 18. The set of gears coupling the second shaft 20 to the first shaft 18 may be located inside or outside of the housing 12. Using the designated electric motor 94 to drive the shafts 18, 20 of the supercharger assembly 10 (instead of the belt drive 92) may allow the supercharger assembly 10 to effectively increase the pressure of the air charged into the cylinders of the engine, even when the engine is at idle or operating at low engine speeds. The ability to increase the air pressure supplied to the engine at low engine speeds may help improve the acceleration performance of the engine by boosting the power of the engine at low speed, and thereby effecting a relatively rapid increase in speed. By comparison, if the shafts 18, 20 of the supercharger assembly 10 are indirectly powered by the crankshaft of the engine, the ability of the supercharger assembly 10 to effectively supply pressurized air to the cylinders of the engine may be limited by the speed of the engine.

Figure 2:
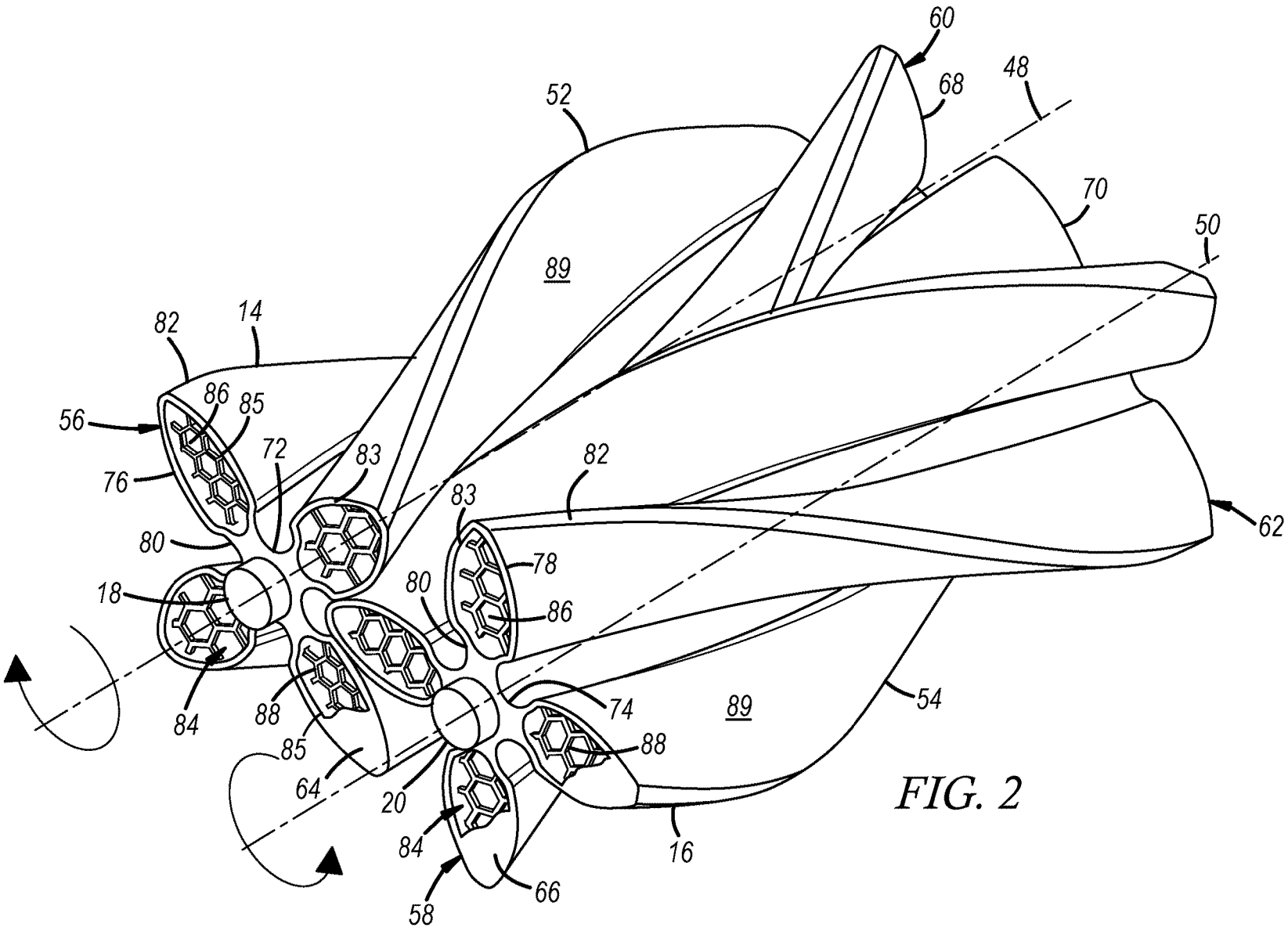
FIG. 2 is a cutaway perspective view of the helical lobed rotors shown in FIG. 1 depicting the internal structure of the rotors.

The first and second rotors 14, 16 are configured to move a fluid (e.g., air) from the inlet 22 to the outlet 28 of the housing 12 and are rotatably supported side by side within the rotor cavity 46 by the first and second shafts 18, 20. As best shown in FIG. 2, the rotors 14, 16 have parallel first and second central longitudinal axes 48, 50 and first and second rotor bodies 52, 54, respectively. The first and second rotor bodies 52, 54 are supported within the rotor cavity 46 such that respective first ends 56, 58 of the bodies 52, 54 are adjacent the inlet 22 of the housing 12 and respective second ends 60, 62 of the bodies 52, 54 are adjacent the outlet 28 of the housing 12. As shown in FIG. 2, in operation, the first rotor body 52 rotates about its central longitudinal axis 48 in a clockwise direction and the second rotor body 54 simultaneously rotates about its central longitudinal axis 50 in a counter-clockwise direction.

Each of the first and second rotor bodies 52, 54 has a first end face 64, 66, an opposite second end face 68, 70, a proximal axially extending hub portion 72, 74, and two or more distal lobe portions 76, 78 extending radially outward from the hub portion 72, 74. In the embodiment depicted in FIGS. 1 and 2, each of the first and second rotor bodies 52, 54 has four circumferentially spaced apart lobe portions 76, 78 extending radially outward from the hub portion 72, 74. The hub portions 72, 74 of the rotor bodies 52, 54 are respectively coupled to the first and second shafts 18, 20 for rotation therewith. The lobe portions 76, 78 extend axially along the corresponding hub portions 72, 74 of the rotor bodies 52, 54, from the first end faces 64, 66 to the second end faces 68, 70 thereof. Each of the rotor bodies 52, 54 may have an axial length defined as the distance between its first and second end faces 64, 66, 68, 70 and a generally constant outer radius defined at a radial outer extent of its lobe portions 76, 78. The size of the rotor bodies 52, 54 may depend upon the specific application of the supercharger assembly 10. In one form, each of the rotor bodies 52, 54 may have an axial length in the range of 10 centimeters to 25 centimeters and an outer radius in the range of 5 centimeters to 15 centimeters.

The configuration of the rotor bodies 52, 54 depicted in FIGS. 1 and 2 is commonly referred to as "roots" type, with each of the lobe portions 76, 78 of the first and second rotor bodies 52, 54 having the same shape. In addition, each of the lobe portions 76, 78 depicted in FIGS. 1 and 2 has a relatively narrow root portion 80 adjacent the hub portion 72, 74 and a radially outer tip 82 at a distal end thereof. In other embodiments, the rotor bodies 52, 54 may be of the "screw" type (not shown). In such case, the hub portions 72, 74 of the rotor bodies 52, 54 may constitute a relatively large fraction of each of the rotor bodies 52, 54 (as compared to roots type rotor bodies), and the lobe portions 76, 78 may have different complementary helical shapes. For example, in screw type rotor bodies, the lobe portions 76, 78 of one of the rotor bodies 52, 54 (the "male" rotor body) may have generally convex flanks, while the other rotor body 52, 54 (the "female" rotor body) may have general concave flanks.

In the embodiment depicted in FIGS. 1 and 2, each of the lobe portions 76, 78 of the rotor bodies 52, 54 follow a twisted or helical path around their respective hub portions 72, 74 as they extend from the first end face 64, 66 to the second end face 68, 70 of the rotor bodies 52, 54. In addition, the rotor bodies 52, 54 are arranged within the housing 12 such that the lobe portions 76 of the first rotor body 52 are twisted in a counter-clockwise direction around the hub portion 72, while the lobe portions 78 of the second rotor body 54 are twisted in a clockwise direction around the hub portion 74. In one form, each of the lobe portions 76, 78 may twist through an angle of 60 degrees or greater as they extend from the first end face 64, 66 to the second end face 68, 70 of the rotor bodies 52, 54. However, in other embodiments, each of the lobe portions 76, 78 may extend in a generally straight path, or in any other suitable path along the hub portions 72, 74 of the rotor bodies 52, 54. The specific twist angle of the lobe portions 76, 78 may depend on the application of the supercharger assembly 10.

Referring now to FIG. 2, in which a portion of the first end faces 64, 66 of the rotor bodies 52, 54 has been cutaway to reveal an interior of the rotor bodies 52, 54. As shown, each of the rotor bodies 52, 54 has a porous inner core 84 entirely enclosed within a solid outer casing 83. In the embodiment depicted in FIG. 2, the porous inner core 84 is segregated into a plurality of discrete porous chambers 85, with each of the lobe portions 76, 78 of the first and second rotor bodies 52, 54 enclosing a single porous chamber 85. Each porous chamber 85 extends radially outward from one of the hub portions 72, 74 toward the radially outer tip 82 of the lobe portion 76, 78 and also extends axially through the lobe portion 76, 78 between the first and second end faces 64, 66, 68, 70 of one of the rotor bodies 52, 54.

In other embodiments, the porous inner core 84 enclosed within each of the rotor bodies 52, 54 may comprise a unitary structure (not shown). For example, in embodiments where the hub portions 72, 74 of the rotor bodies 52, 54 make up a relatively large fraction of the rotor bodies 52, 54 (such as in screw type rotor bodies), each of the rotor bodies 52, 54 may comprise a unitary porous inner core that extends radially and axially within each of the lobe portions 76, 78 and is united at the center of the rotor body 52, 54 within the hub portion 72, 74. Or each of the rotor bodies 52, 54 may comprise a unitary porous inner core that extends radially and axially within the hub portion 72, 74 of the rotor body 52, 54, but does not extend into the lobe portions 76, 78 of the rotor body 52, 54.

The porous inner core 84 enclosed within each of the rotor bodies 52, 54 effectively reduces the weight of the rotor bodies 52, 54 (in comparison to entirely solid rotor bodies), without sacrificing the structural integrity of the rotor bodies 52, 54. In one form, the porous inner cores 84 may comprise multidimensional stochastic or periodic support structures, which may have closed or open interconnected pores. For example, the porous inner cores 84 enclosed within each of the rotor bodies 52, 54 may comprise a two or three-dimensional lattice support structure or truss including a plurality of repeating unit cells (e.g., a tessellation of one or more geometric shapes) defined by a plurality of discrete segments connected at their ends.

In the embodiment depicted in FIG. 2, the porous inner cores 84 enclosed within each of the rotor bodies 52, 54 comprise a plurality of open interconnected pores 86 defined by multiple planar lattice support structures 88 spaced apart from one another between the first and second end faces 64, 66, 68, 70 of the rotor bodies 52, 54. In the embodiment depicted in FIG. 2, the planar lattice support structures 88 are made up of a plurality of repeating hexagonal or honeycomb-shaped unit cells. However, in other embodiments, the lattice support structures 88 may be made up of unit cells of different shapes, such as circular, elliptical, or polygonal shapes, e.g., triangular, rectangular, square, quadrilateral, or octagonal, to name a few. In some embodiments, the porous inner cores 84 may be defined by a spatial or three-dimensional contiguous lattice support structure (not shown), which may be made up of one or more stochastic or periodic unit cells. For example, the porous inner cores 84 may be defined by a three-dimensional lattice support structure that includes multiple circular, elliptical, or polygonal-shaped columnar pores extending between the first and second end faces 64, 66, 68, 70 of the rotor bodies 52, 54, with each of the columnar pores being separated from one another by solid walls. As another example, the porous inner cores 84 may be defined by a three-dimensional lattice support structure that includes multiple hollow polyhedral-shaped cells separated by solid walls. In one form, the porous inner cores 84 may have a reticulated structure.

The solid outer casing 83 may have a smooth, textured, patterned, or otherwise engineered outer surface 89. The outer surface 89 of the solid outer casing 83 may be configured to control or adjust the airflow along the rotor bodies 52, 54. For example, the outer surface 89 of the solid outer casing 83 may be configured to reduce or eliminate turbulent air flow within the boundary layer over the outer surface 89, which may increase the efficiency of the supercharger assembly 10 and/or decrease the noise generated during operation of the supercharger assembly 10. In one form, the outer surface 89 of the solid outer casing 83 may include a plurality of perforations, suction slots, porosity, or a plurality of waves or ridges oriented generally parallel to the direction of fluid flow over the outer surface 89 to help promote laminar flow along the outer surface 89.

In one form, the first and second rotor bodies 52, 54 may be manufactured by an extrusion process in which a solid or hollow profile is formed and optionally twisted into a desired shape. Additionally or alternatively, the first and second rotor bodies 52, 54 may be manufactured via an additive manufacturing process, in which digital design data is used to build up the rotor bodies 52, 54 layer by layer. For example, in one form, the rotor bodies 52, 54 may be manufactured via a powder bed fusion process, which may be carried out using selective laser sintering, direct metal laser sintering, selective laser melting, selective heat sintering, or electron beam melting techniques. In a powder bed fusion process, a layer of metal particles (powdered building material) is spread out on a building platform and then a high power laser beam or electron beam is directed at the particles on the building platform and advanced along a computer controlled path to melt and fuse the metal particles together along the path. After the first layer of fused material is complete, the building platform is lowered to a depth equal to the height of the next material layer and another layer of metal particles is spread out on the building platform over the first layer. A high power laser beam or electron beam is again directed at the new layer of metal particles on the building platform and advanced along a computer controlled path to melt and fuse the metal particles together to form a second layer of fused material over the first layer. The process is repeated until all successive layers of fused material are built up. In another form, the rotor bodies 52, 54 may be manufactured via a directed energy deposition process, in which a metal building material in powder or wire form is supplied to a nozzle mounted for movement along multiple axes and then deposited by the nozzle onto a target surface. A laser beam is immediately directed at the building material deposited on the target surface to melt and fuse the material together. Subsequent layers of material are built up over the preceding layer or over another target surface, and the shape of the layers of material is controlled by managing the feed rate of the powder or wire building material and the angle at which the building material is deposited.

The additive manufacturing processes described above—or any other suitable additive manufacturing process—may be used independently or in combination other manufacturing processes to produce the first and second rotor bodies 52, 54. In one form, the rotor bodies 52, 54 may initially be formed with a porous inner core 84 and a solid outer casing 83 that does not include solid first and second end faces 64, 66, 68, 70. Initially forming the rotor bodies 52, 54 with open first and second ends 56, 58, 60, 62 may allow for further refinement and/or material removal from the porous inner core 84 of the rotor bodies 52, 54 prior to capping the first and second end faces 64, 66, 68, 70 with a solid layer of material such that the porous inner core 84 is entirely enclosed within a unitary solid outer casing 83.

Figure 3:
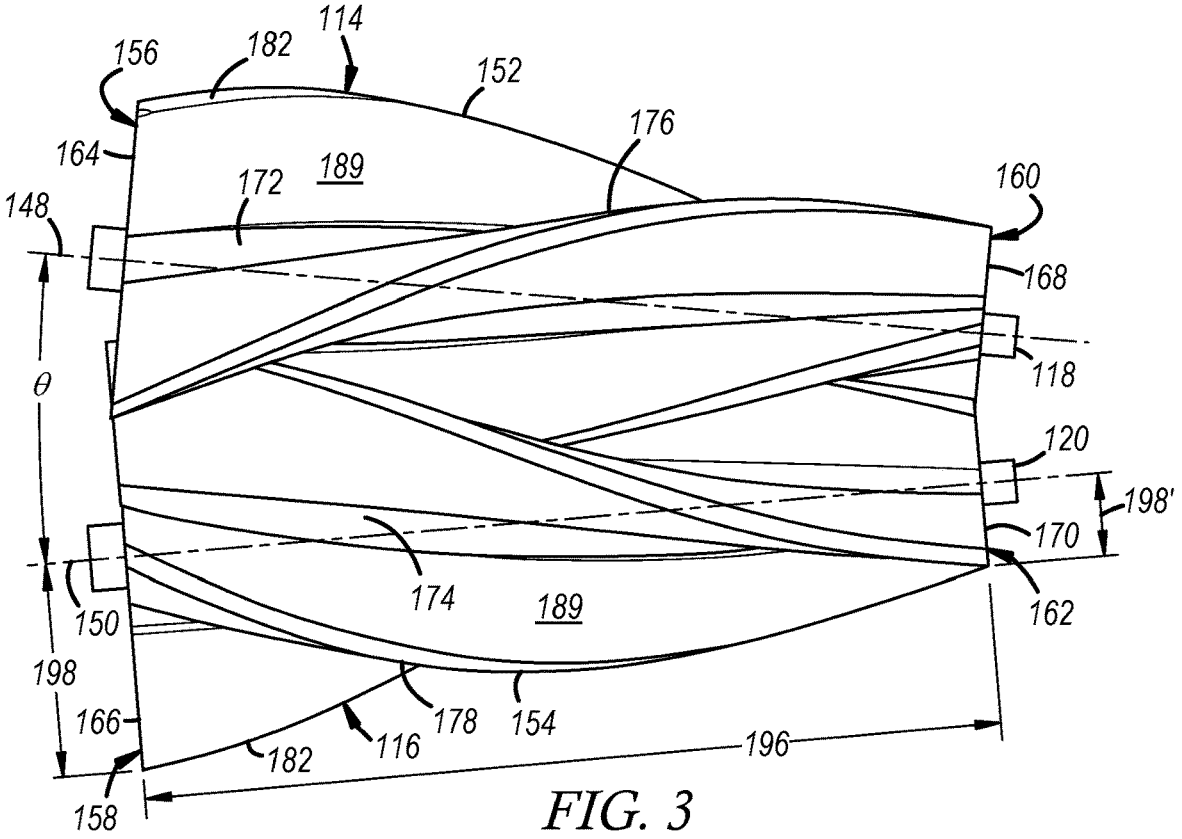
FIG. 3 is a top view of a pair of intermeshing tapered helical lobed rotors for a compressor assembly.
Figure 4:
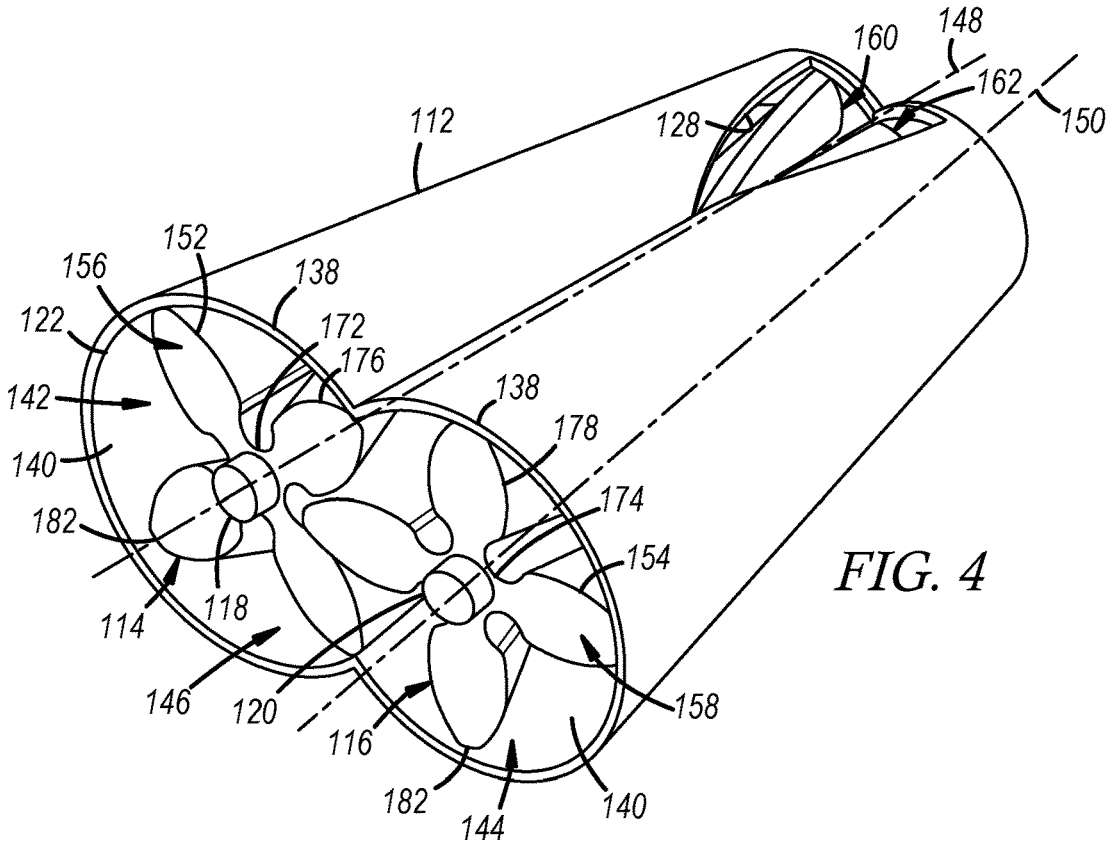
FIG. 4 is a perspective view of the tapered helical lobed rotors shown in FIG. 3 disposed within a housing defining a pair of interconnected frustoconical rotor cavities.

Referring now to FIGS. 3 and 4, which depict a pair of intermeshing first and second rotors 114, 116 for a positive displacement compressor assembly (not shown). As shown in FIG. 4, the rotors 114, 116 are rotatably supported side by side within a housing 112 and are configured to move a fluid (e.g., air) from an inlet 122 to an outlet 128 of the housing 112. The housing 112 includes a pair of intersecting frusto-conical sidewalls 138 having inner wall surfaces 140 that respectively define first and second interconnected frusto-conical rotor cavities 142, 144, which together form a larger unitary rotor cavity 146 within the housing 112. The rotors 114, 116 are rotatably supported within the housing 112 by a pair of first and second shafts 118, 120. The first shaft 118 is coaxial with the first rotor 114 and with the first rotor cavity 142, and the second shaft 120 is coaxial with the second rotor 116 and with the second rotor cavity 144.

The rotors 114, 116 depicted in FIGS. 3 and 4 respectively have first and second tapered rotor bodies 152, 154 with first and second central longitudinal axes 148, 150 that approach each other and form an acute angle θ therewith. The acute angle θ formed between the first and second central longitudinal axes 148, 150 of the tapered rotor bodies 152, 154 may be in the range of 5 degrees to 30 degrees, and may depend upon the application of the compressor assembly. The first and second rotor bodies 152, 154 are supported within the rotor cavity 146 such that respective first ends 156, 158 of the bodies 152, 154 are adjacent the inlet 122 of the housing 112 and respective second ends 160, 162 of the bodies 152, 154 are adjacent the outlet 128 of the housing 112. As shown in FIG. 4, in operation, the first rotor body 152 rotates about its central longitudinal axis 148 in a clockwise direction and the second rotor body 154 simultaneously rotates about its central longitudinal axis 150 in a counter-clockwise direction.

Each of the first and second rotor bodies 152, 154 has a first end face 164, 166, an opposite second end face 168, 170, a proximal axially extending hub portion 172, 174, and two or more distal lobe portions 176, 178. In the embodiment depicted in FIGS. 3 and 4, each of the first and second rotor bodies 152, 154 has four distal lobe portions 176, 178. The hub portions 172, 174 of the rotor bodies 152, 154 are respectively coupled to the first and second shafts 118, 120 for rotation therewith. Each of the lobe portions 176, 178 extend radially outward from their respective hub portions 172, 174 to a radially outer tip 182 at a radial outer extreme thereof. The lobe portions 176, 178 also extend axially along the hub portions 172, 174, from the first end faces 164, 166 to the second end faces 168, 170 of the rotor bodies 152, 154.

The configuration of the rotor bodies 152, 154 depicted in FIGS. 3 and 4 are of the roots type, as discussed above with respect to FIGS. 1 and 2. However, in other embodiments, the rotor bodies 152, 154 may be of the "screw" type (not shown). Also, although the lobe portions 176, 178 of the rotor bodies 152, 154 follow a twisted or helical path around their respective hub portions 172, 174, in other embodiments, each of the lobe portions 176, 178 may extend in a generally straight path, or in any other suitable path along the hub portions 172, 174 of the rotor bodies 152, 154. Each of the rotor bodies 152, 154 may or may not have a porous inner core (not shown), as discussed above with respect to FIGS. 1 and 2. Each of the rotor bodies 152, 154 may or may not have a smooth, textured, patterned, or otherwise engineered outer surface 189, as discussed above with respect to FIGS. 1 and 2.

Each of the rotor bodies 152, 154 has an axial length 196 and an outer radius at any given location along its axial length 196 defined by the radially outer tips 182 of its lobe portions 176, 178. Also, each of the rotor bodies 152, 154 is tapered, and thus each of the rotor bodies 152, 154 has an outer radius 198 at the first end 156, 158 thereof that is greater than the outer radius 198' at the second end 160, 162 thereof. The size of the rotor bodies 152, 154 may depend upon the specific application of the compressor assembly. In one form, each of the rotor bodies 152, 154 may have an axial length 196 in the range of 10 centimeters to 25 centimeters. In addition, in one form, each of the rotor bodies 152, 154 may have an outer radius 198 at the first end 156, 158 thereof in the range of 5 centimeters to 15 centimeters and an outer radius 198' at the second end 160, 162 thereof in the range of 2 centimeters to 7 centimeters. In one form, the outer radius 198 at the first ends 156, 158 of the rotor bodies 152, 154 may be two to four times larger than the outer radius 198' at the second ends 160, 162 of the rotor bodies 152, 154.

The sidewalls 138 of the housing 112 are configured such that a minimal and constant amount of clearance exists between the inner wall surfaces 140 of the sidewalls 138 and the radially outer tips 182 of the rotor bodies 152, 154. As such, each of the intersecting frustoconical sidewalls 138 may have an inner diameter adjacent the first ends 156, 158 of the rotor bodies 152, 154 that is greater than the inner diameter of the intersecting frustoconical sidewalls 138 adjacent the second ends 160, 162 of the rotor bodies 152, 154. In one form, the inner diameter of the intersecting frustoconical sidewalls 138 adjacent the first ends 156, 158 of the rotor bodies 152, 154 also may be two to four times larger than the inner diameter of the intersecting frustoconical sidewalls 138 adjacent the second ends 160, 162 of the rotor bodies 152, 154.

The presently disclosed tapered rotor bodies 152, 154 exhibit a number of advantages, as compared to rotor bodies having constant outer radii. In particular, during operation of a compressor assembly that includes a pair of roots type rotor bodies having constant outer radii, such as the rotor bodies 52, 54 depicted in FIGS. 1 and 2, the counter-rotation of the rotor bodies 52, 54 causes a fixed volume of fluid to be drawn into the inlet 22 of the housing 12, transported in a sealed pocket around the rotor bodies 52, 54, and then expelled from the outlet 28 of the housing 12. Notably, in such a system, the volume of fluid transported by the counter-rotating rotor bodies 52, 54 is fixed, meaning that it is not compressed or pressurized until it is forced out of the outlet 28 of the housing 12 against the downstream pressure within the outlet plenum 32. Due to the relatively high pressure within the outlet plenum 32, back flow and pulsing may occur as successive volumes of air are discharged into the outlet plenum 32.

Alternatively, when a volume of fluid is drawn into the inlet 122 of the housing 112 by the counter-rotation of the tapered rotor bodies 152, 154 depicted in FIGS. 3 and 4, the fluid is transported in a sealed pocket around the rotor bodies 152, 154 that gradually decreases in volume from the inlet 122 to the outlet 128 of the housing 112, which effectively increases the pressure of the fluid between the inlet 122 and the outlet 128 of the housing 112. Pressurizing the fluid along the axial length of rotor bodies 152, 154 in this way reduces the pressure differential between the fluid that is being discharged from the outlet 128 of the housing 112 and the fluid downstream thereof, which can help minimize the instances and/or magnitude of backflow and pulsing.

The first and second shafts 118, 120 may be powered via the internal combustion engine with which the rotors 114, 116 are associated. Alternatively, due to the tapered configuration of the rotor bodies 152, 154, the rotor bodies 152, 154 may be relatively light weight, as compared to rotor bodies having constant outer radii, which may allow the first and second shafts 118, 120 to be driven by a designated electric motor, such as the electric motor 94 depicted in FIG. 1.

The first and second rotor bodies 152, 154 may be manufactured via an additive manufacturing process, such as the powder bed fusion process or the directed energy deposition process described above with respect to FIGS. 1 and 2.

The above description of preferred exemplary embodiments and specific examples are merely descriptive in nature; they are not intended to limit the scope of the claims that follow. Each of the terms used in the appended claims should be given its ordinary and customary meaning unless specifically and unambiguously stated otherwise in the specification.

What is claimed is:

1. A rotor for a positive displacement compressor assembly having a housing defining an inlet, an outlet, and a rotor cavity in communication with the inlet and the outlet, the rotor comprising:

a rotor body having a central longitudinal axis, a first end adjacent the inlet of the housing, a second end adjacent the outlet of the housing, an axially extending hub, and a plurality of lobes extending radially outward from the hub and axially along the hub from the first end to the second end of the rotor body, wherein the rotor body comprises a solid outer casing and a porous inner core enclosed within the solid outer casting, wherein the porous inner core extends between the first end and the second end of the rotor body, and wherein the rotor body has an outer radius, and wherein the outer radius of the rotor body at the first end thereof is greater than the outer radius of the rotor body at the second end thereof.

2. The rotor set forth in claim 1 wherein the porous inner core comprises a plurality of discrete porous chambers, with each of the plurality of lobes enclosing one of the discrete porous chambers.

3. The rotor set forth in claim 1 wherein the porous inner core comprises a unitary structure enclosed within the solid outer casing of the rotor body.

4. The rotor set forth in claim 1 wherein the porous inner core comprises a multidimensional stochastic or periodic support structure.

5. The rotor set forth in claim 1 wherein the porous inner core comprises a two or three-dimensional lattice support structure or truss including a plurality of repeating unit cells.

6. The rotor set forth in claim 1 wherein each of the plurality of lobes extends in a helical path along the rotor body.

7. The rotor set forth in claim 1 wherein the solid outer casing of the rotor body has a textured or patterned outer surface.

8. A positive displacement compressor assembly comprising:

a housing defining an inlet and an outlet, the housing including a pair of end walls and a pair of intersecting sidewalls having inner wall surfaces that define first and second interconnected rotor cavities;

first and second shafts extending within the rotor cavities and supported for rotation at the end walls; and a pair of intermeshing first and second rotors respectively supported within the first and second rotor cavities by the first and second shafts, wherein the first and second rotors respectively comprise first and second rotor bodies having respective first and second central longitudinal axes, respective first ends adjacent the inlet of the housing, and respective second ends adjacent the outlet of the housing, wherein each of the first and second rotor bodies has a first end face, an opposite second end face, an axially extending hub coupled to one of the shafts for rotation therewith, and a plurality of lobes extending radially outward from the hub and axially along the hub from the first end face to the second end face thereof, wherein a porous inner core is enclosed within each of the first and second rotor bodies, and wherein the first and second rotor cavities are frustoconical in shape.

9. The compressor assembly set forth in claim 8 wherein the first and second rotor cavities are cylindrical in shape.

10. The compressor assembly set forth in claim 8 wherein each of the first and second rotor bodies has an outer radius, and wherein the outer radii of the first and second rotor bodies at the first ends thereof is greater than the outer radii of the first and second rotor bodies at the second ends thereof.

11. The compressor assembly set forth in claim 8 wherein the first and second central longitudinal axes of the first and second rotor bodies approach each other as the rotor bodies extend from the inlet to the outlet of the housing and form an acute angle therebetween.

12. The compressor assembly set forth in claim 8 wherein the first and second shafts extend outside the housing to form at least one drive shaft, and wherein the at least one drive shaft is driven by an electric motor.

13. The compressor assembly set forth in claim 8 wherein the plurality of lobes of the first and second rotor bodies have different complementary helical shapes.

14. The compressor assembly set forth in claim 8 wherein the plurality of lobes of the first rotor body are the same shape as the plurality of lobes of the second rotor body.

15. The compressor assembly set forth in claim 8 wherein the compressor assembly is a supercharger assembly for an internal combustion engine.

16. A positive displacement compressor assembly comprising:

a housing defining an inlet and an outlet, the housing including a pair of end walls and a pair of intersecting sidewalls having inner wall surfaces that define first and second interconnected rotor cavities;

first and second shafts extending within the rotor cavities and supported for rotation at the end walls; and a pair of intermeshing first and second rotors respectively supported within the first and second rotor cavities by the first and second shafts, wherein the first and second rotors respectively comprise first and second rotor bodies having respective first and second central longitudinal axes, respective first ends adjacent the inlet of the housing, and respective second ends adjacent the outlet of the housing, wherein each of the first and second rotor bodies has a first end face, an opposite second end face, an axially extending hub coupled to one of the shafts for rotation therewith, and a plurality of lobes extending radially outward from the hub and axially along the hub from the first end face to the second end face thereof, wherein a porous inner core is enclosed within each of the first and second rotor bodies, and wherein the first and second central longitudinal axes of the first and second rotor bodies approach each other as the rotor bodies extend from the inlet to the outlet of the housing and form an acute angle therebetween.

* * * * *